US009884496B1

(12) United States Patent
VanKouwenberg

(10) Patent No.: US 9,884,496 B1
(45) Date of Patent: Feb. 6, 2018

(54) SYSTEM FOR DETECTING CONTAMINATION ON DECURLER ROLLERS IN AQUEOUS INK PRINTERS

(71) Applicant: Xerox Corporation, Norwalk, CT (US)

(72) Inventor: David A. VanKouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/465,778

(22) Filed: Mar. 22, 2017

(51) Int. Cl.

| | |
|---|---|
| ***B41J 29/38*** | (2006.01) |
| ***B41J 2/01*** | (2006.01) |
| ***B41J 13/00*** | (2006.01) |
| ***B41J 11/00*** | (2006.01) |
| ***B41J 3/60*** | (2006.01) |
| ***G03G 15/00*** | (2006.01) |

(52) U.S. Cl.
CPC ..... *B41J 13/0009* (2013.01); *B41J 3/60* (2013.01); *B41J 11/0005* (2013.01); *G03G 15/6576* (2013.01)

(58) Field of Classification Search
CPC ..... B41J 13/0009; B41J 11/0005; B41J 3/60; G03G 15/6576
USPC ..... 347/5, 16, 101, 104
See application file for complete search history.

(56) References Cited

U.S. PATENT DOCUMENTS

| | | | | |
|---|---|---|---|---|
| 6,229,968 | B1 | 5/2001 | Martin et al. | |
| 6,389,241 | B1 | 5/2002 | Cernusak et al. | |
| 7,837,322 | B2 * | 11/2010 | Kusuhata | B41J 11/0005 347/101 |
| 9,020,412 | B2 * | 4/2015 | Osaki | G03G 15/6576 399/406 |
| 9,229,411 | B2 | 1/2016 | Furushige et al. | |
| 9,440,814 | B1 | 9/2016 | Lefevre et al. | |
| 9,457,591 | B1 | 10/2016 | LeFevre et al. | |
| 9,465,330 | B2 | 10/2016 | Morimoto | |

* cited by examiner

*Primary Examiner* — An Do
(74) *Attorney, Agent, or Firm* — Maginot Moore & Beck LLP

(57) ABSTRACT

A decurler is configured for use in an aqueous inkjet printer to monitor ink contamination of the indent roller in the decurler and generate a signal that maintenance is required prior to the printer beginning to produce wrinkled media sheets by the ink contamination on the indent roller. A reflective sensor is mounted on a shaft for bidirectional movement to sweep the length of the indent roller and generate electrical signals indicative of the presence or absence of contamination on the indent roller. The controller receiving signals from the reflective sensor compares the signals from the reflective sensor to a predetermined threshold prior to commencing monitoring of the indent roller to determine positions where the sensor is opposite the indent roller and positons where the sensor is opposite a frame in the printer.

20 Claims, 3 Drawing Sheets

SYSTEM FOR DETECTING CONTAMINATION ON DECURLER ROLLERS IN AQUEOUS INK PRINTERS

TECHNICAL FIELD

This disclosure relates generally to inkjet printers that eject aqueous ink directly onto media and, more particularly, to maintaining a decurler within such a printer.

BACKGROUND

In general, inkjet printers include at least one printhead having a plurality of inkjets that eject drops of liquid ink onto a recording or image forming surface. In some inkjet printers, the printhead ejects ink directly onto the surface of media as the media passes the printhead. The media can be in the form of a continuous web or in the form of sheets. In continuous web printers, the media is pulled from a supply roll by actuator-driven rollers. As the web moves through the printer it passes around rollers to which tension is applied to keep the web taut as it passes through the printer to a take-up roll. In sheet printers, actuator-driven rollers are positioned against one another to form nips and these nips pull sheets from a media supply and propel them through the printer to an output tray.

In inkjet printers that eject ink directly onto sheets, media deformation occurs more frequently in sheet printers than continuous web printers since a web is generally taut as it passes through the printer. Sheets, however, can absorb moisture from the inks ejected onto the sheets and this moisture can cause curling or other deformations in the media sheets. These deformations are particularly troublesome in inkjet printers that employ water-based or solvent-based inks in which pigments or other colorants are suspended or are in solution with water or another solvent. The water and solvents in the inks can change the physical properties of the sheets in ways that degrade the quality of the images produced on the media sheets. In these aqueous ink printers, an unacceptable level of curl can be induced on the printed sheet by the image, particularly when a solid stripe of ink is printed on the leading edge of a sheet. To address the curl in a sheet, a device known as a decurler is used to induce curl in the sheet in the opposite direction to counteract the curl induced by the printed image on the sheet. This function is important, particularly when the printed sheet is delivered to an in-line stacker, which can only handle sheets having curl no greater than a predetermined radius.

A decurler in an aqueous inkjet printer has an indent roller and an elastomeric roller. An actuator operatively connected to the elastomeric roller pushes the roller into the indent roller as the rotation of the two rollers passes a sheet between them. This action induces curl into the sheet in the opposite direction of the curl induced by the ink image on the sheet to reduce the curl in the sheet to a level that enables the stacker to handle the sheet. Because the indent roller contacts the ink on the freshly printed side of the media, some of the ink can adhere to the roller. The ink adhering to the indent shaft can build to levels that adversely impact the ability of the decurler to induce opposite curl in the media sheets and may wrinkle the sheet in the decurler. Generally, wrinkled sheets are not acceptable to printer users. The appearance of wrinkled sheets in the output tray requires printer down time for maintenance of the decurler to remove the ink from the indent roller and the discarding of the wrinkled sheets. Detection of ink adherence to the indent roller would enable maintenance to be performed on the indent roller before the printed sheets begin to wrinkle and be discarded.

SUMMARY

A decurler for use in an aqueous ink printer enables adhering ink on an indent roller in the decurler to be detected before enough ink has accumulated to cause wrinkling. The decurler includes an indent roller having a first end and a second end, an elastomeric roller having a first end and a second end, the elastomeric roller and indent roller being parallel to one another and the elastomeric roller being configured to move to form a nip with the indent roller selectively to enable media sheets to pass through the nip and induce a curl in the media sheets that is opposite to a curl induced in the media sheets by aqueous ink ejected onto the media sheets prior to entry into the nip between the indent roller and the elastomeric roller, a reflective sensor having a light emitter that is oriented to direct light onto a surface of the indent roller of the decurler and a light receiver that is oriented to receive specular reflections of the light directed onto the surface of the indent roller and to generate an electrical signal indicative of an amount of specular light reflection received by the light receiver from the surface of the indent roller, and a controller operatively connected to the reflective sensor to receive the electrical signal generated by the light receiver of the reflective sensor. The controller is configured to compare a magnitude of the electrical signal to a predetermined threshold and store an indication for maintenance of the indent roller in a memory in response to the magnitude of the electrical signal being less than the predetermined threshold.

A printer that enables adhering ink on an indent roller in a decurler within the printer to be detected before enough ink has accumulated to cause wrinkling. The printer includes a media feeding system configured to remove media sheets from a media sheet receptacle, a media transport system configured to move media sheets through the aqueous inkjet printer, at least one printhead configured to eject drops of aqueous ink onto media sheets as the media transport system moves the media sheets past the at least one printhead, a decurler having an indent roller and an elastomeric roller, the elastomeric roller being configured to move and form a nip with the indent roller in the decurler to enable media sheets to pass through the nip and induce a curl in the media sheets that is opposite to a curl induced in the media sheets by aqueous ink ejected by the at least one printhead onto the media sheets prior to entry into the decurler, a reflective sensor having a light emitter that is oriented to direct light onto a surface of the indent roller of the decurler and a light receiver that is oriented to receive specular reflections of the light directed onto the surface of the indent roller and to generate an electrical signal indicative of an amount of specular light reflection received by the light receiver from the surface of the indent roller, and a controller operatively connected to the reflective sensor to receive the electrical signal generated by the light receiver of the reflective sensor. The controller is configured to compare a magnitude of the electrical signal to a predetermined threshold and store an indication for maintenance of the indent roller in a memory in response to the magnitude of the electrical signal being less than the predetermined threshold.

BRIEF DESCRIPTION OF THE DRAWINGS

The foregoing aspects and other features of an apparatus that detects ink accumulation on an indent roller in a decurler are explained in the following description, taken in connection with the accompanying drawings.

DETAILED DESCRIPTION

Figure 1:
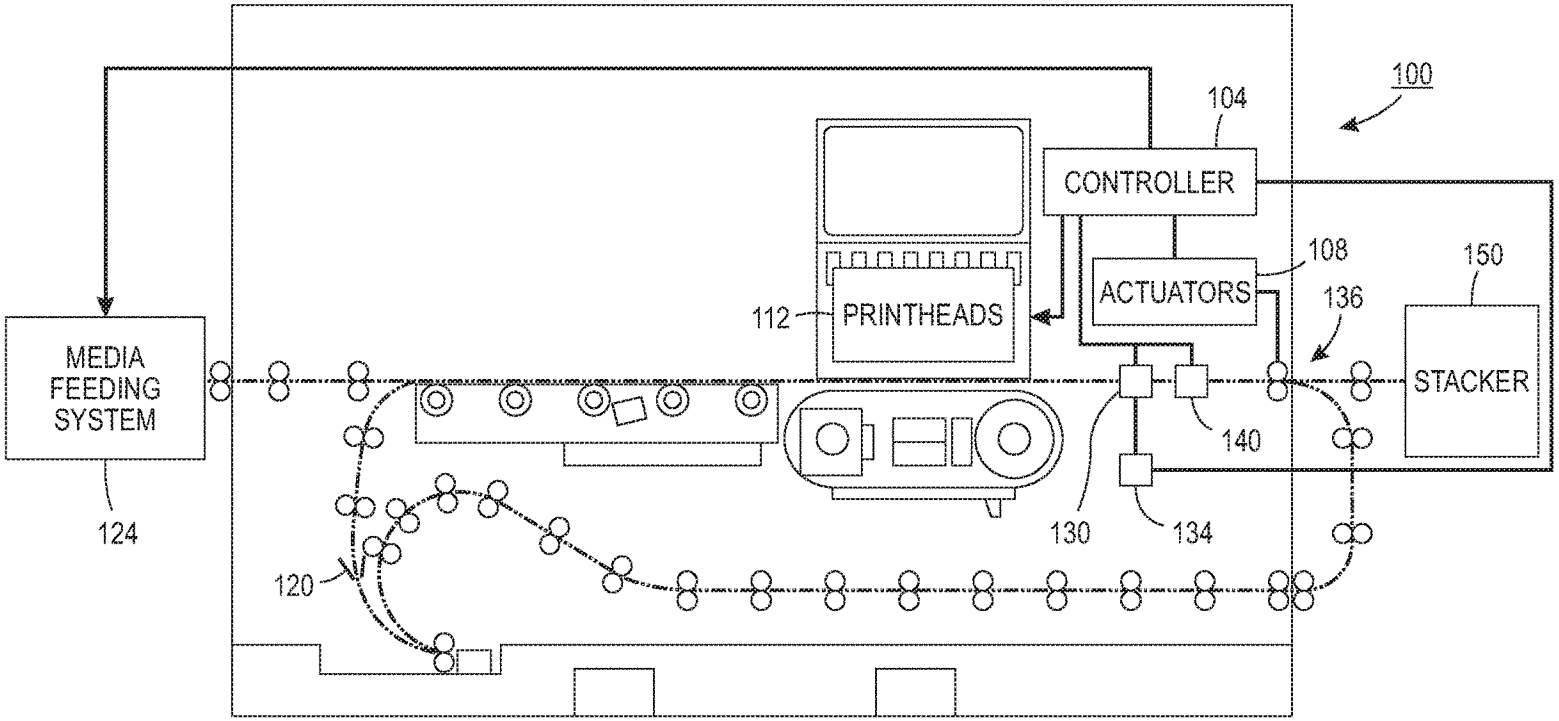
FIG. 1 is diagram of an inkjet printer that compensates for media wrinkle prior to the media reaching a stacker apparatus.

For a general understanding of the environment for the indent roller ink contamination detector as well as the details for the detector, reference is made to the drawings. In the drawings, like reference numerals designate like elements. As used in this document, the terms "printer," "printing device," or "imaging device" generally refer to a device that produces an image on print media with liquid ink and may encompass any such apparatus, such as a digital copier, bookmaking machine, facsimile machine, multi-function machine, or the like, which generates printed images for any purpose. Image data generally include information in electronic form that a controller renders and uses to operate the inkjet ejectors in printheads to form an ink image on media sheets. These data can include text, graphics, pictures, and the like. The operation of producing images with colorants on print media, for example, graphics, text, photographs, and the like, is generally identified in this document as printing or marking. Aqueous inkjet printers are printers that use inks having a high percentage of water relative to the amount of colorant and solvent in the ink. The term 'sheet' in this document refers to any relatively flexible planar member made of paper, plastic, media, or other printable substrate, whether precut or initially web fed.

The term "printhead" as used in this document refers to a component in the printer that is configured with inkjet ejectors to eject liquid ink drops onto a surface of a sheet. A typical printhead includes a plurality of inkjet ejectors that eject ink drops of one or more ink colors onto the sheet in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. A sheet moves past the printheads in a process direction through the print zone. The inkjets in the printheads eject ink drops in rows in a cross-process direction, which is perpendicular to the process direction across the sheet. As used in this document, the term "aqueous ink" includes liquid inks in which colorant is in a solution, suspension or dispersion within a liquid that includes water and perhaps one or more liquid solvents. The terms "liquid solvent" or more simply "solvent" are used broadly to include liquids that dissolve colorants into a solution or that hold particles of colorant in a suspension or dispersion without dissolving the colorant.

FIG. 1 shows a configuration of an inkjet printer 100 that includes a controller 104, one or more actuators 108, a printhead assembly 112, a transport system 120, and a media feeding system 124. The controller 104 is operatively connected to the actuators 108, the printhead assembly 112, and the media feeding system 124. The controller 104 is configured to receive image data from an image data source and generate firing signals for the operation of the printheads in the printhead assembly 112 for the formation of ink images on media sheets as the sheets pass the printheads. The media sheets are stored in the media feeding system 124 and the controller operates the media feeding system to retrieve media sheets from a storage receptacle for the sheets and feed the sheets into the transport system 120. The controller operates the actuators 108 to drive rollers within the transport system 120 to move the media sheets along a path in the transport system that moves the sheets past printhead assembly 112. After printing, the sheets pass through decurler 130, which induces a curl into the sheets that is opposite to the curl induced in the sheets by the absorption of water. A second decurler 140 is optionally provided for further leveling of the sheets. When the sheets reach position 136, they are either ejected from the transport system into a conventional stacker 150 for retrieval or they are diverted to the lower path of the transport system. The lower path is configured for flipping the sheets over so the unprinted side of the sheets can be returned to the path that carries the sheets past the printhead assembly 112 for printing. If both sides of a sheet are printed, then when the sheets reach position 136 they are directed into stacker 150 for retrieval.

Decurler 130 includes an ink contamination sensor 134 that generates a signal indicative of the presence of ink or other adherents to the surface of the indent roller in the decurler 130. The structure of the sensor 134 is described in more detail below. Although not shown, if the optional decurler 140 is provided, it can also be configured with an ink contamination sensor 134 that generates a signal indicative of the surface of the indent roller in the decurler 140. The sensor 134 may not be necessary, however, for decurler 140 since the recently deposited ink on the media sheets is more likely to adhere to the indent roller of decurler 130 rather than the indent roller of the decurler 140.

To operate the inkjet ejectors in the printheads of the printhead assembly 112, the controller 104 receives a file of image data of an image to be produced on the media sheet. This image can include text alone, graphics alone, or a combination of text and graphics. These image data can be provided by a scanner or by an application program in a known manner. The controller 104 generates color separations and renders the color separations to produce halftone data. These halftone data can be provided to a printhead controller in the printhead assembly 112 for the generation of firing signals or the controller 104 can generate the firing signals and download them to the printhead controller in the assembly 112. The printhead assembly then operates the inkjet ejectors in the printheads of the printhead assembly 112 to eject ink drops onto the media sheet as the sheet passes the printheads to form an ink image on the sheet. Additionally, the controller 104 generates signals to operate one or more of the actuators 108 to coordinate the movement of media sheets through the printer 100 and the operation of the inkjet ejectors in the printheads of the printhead assembly 112.

Figure 2A:
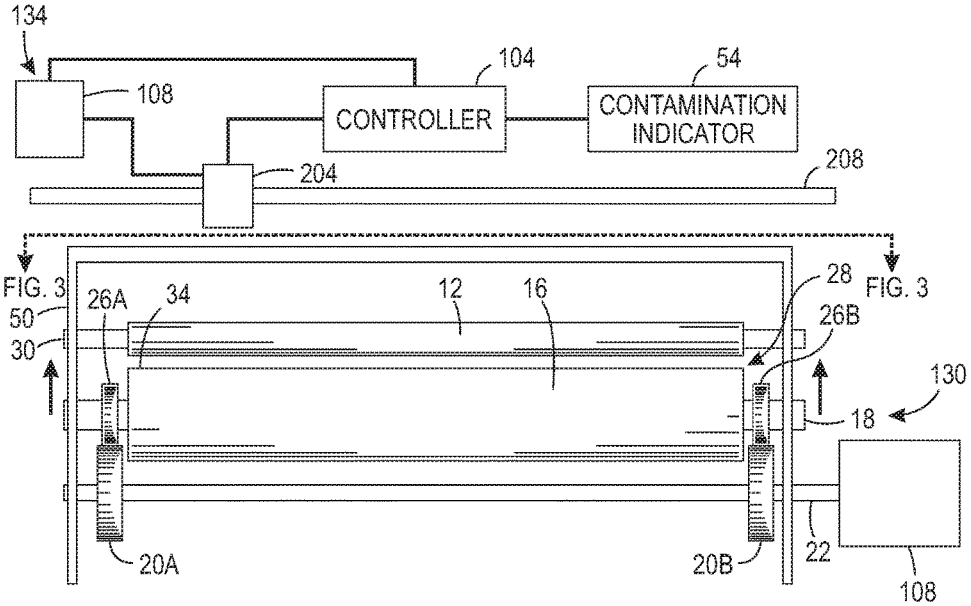
FIGS. 2A and 2B are frontal views of a decurler and an ink contamination detector.
Figure 2B:
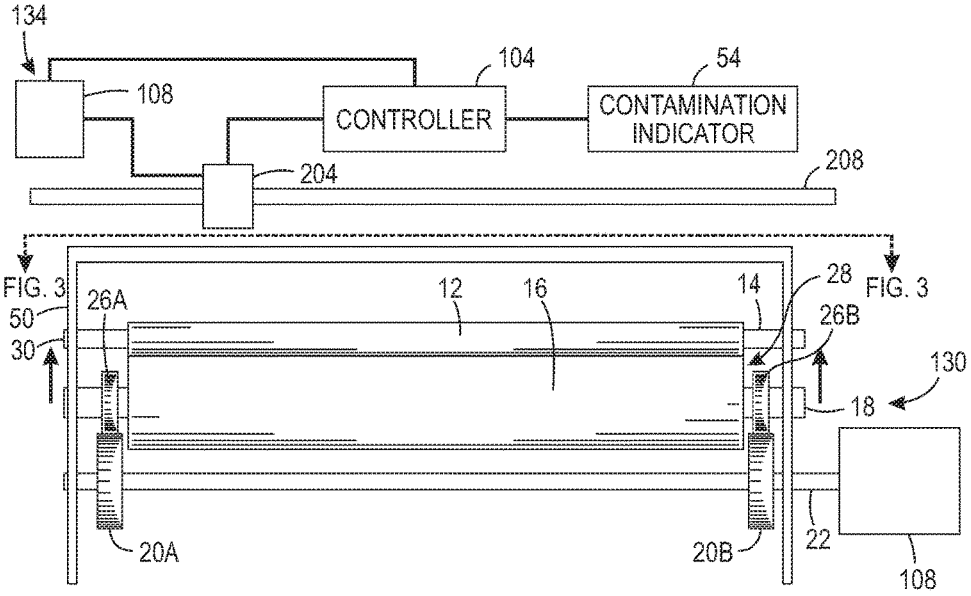

Turning to FIGS. 2A-2B, an indent roller 12 is mounted on a shaft 30 and is rotatable around a longitudinal axis of the shaft. As shown, the shaft 30 alone performs as an axle for the indent roller 12, but embodiments are not so limited and the shaft 30 may be mounted about a separate axle. The shaft 30 may be driven by an independent motor (not shown). An opposing elastomeric roller 16 is mounted on a shaft 18 and is likewise rotatable with the axle 18 around a longitudinal axis of the shaft 18. Elastomeric roller 16 and shaft 18 are further optionally driven by an actuator 108, such as a motor, instead of or in addition to a rotational force driving the shaft 30 of the indent roller 12. Likewise, shaft 30 may be driven by a separate motor instead of or in addition to the rotational force driving the shaft 18 of roller 16. Elongated slots or holes with bearings are provided in frame 50 to accommodate the ends of shafts 30, 18, and 22. For example, the ends of shaft 18 require a slot to accommodate the translation of the shaft and the elastomeric roller 16, as described in more detail below, while the ends of shaft 30 fit within bearings mounted in circular holes in the frame 50. Similarly, shaft 22 fits within a bearing mounted in a circular hole in frame 50 to enable actuator 108 to rotate the shaft and the cams mounted to the shaft.

The shaft 18 is mounted to translate in a direction transverse to the longitudinal axis of the shaft 30 to bring a surface 34 the elastomeric roller 16 into engagement with the indent roller 12. In one embodiment, one or more cams 20A, 20B may be mounted on a shaft 22 and may rotate with the shaft 22. The shaft 22 is in turn driven by an actuator 108, which can be a stepper motor as shown in the figure, to position and hold the cams 20A, 20B, which act on the shaft 18 through cam followers 26A, 26B, which are mounted about the shaft 18 as collars on the shaft 18. Alternatively or additionally, the actuator 108 may comprise a servo motor, a hybrid motor, or a fluid-powered motor. Optionally the cams may be moved linearly rather than or in addition to being moved rotationally. Within the range of the transverse motion of the elastomeric roller 16, space 28, as shown in FIG. 2A, admits a media sheet. The elastomeric roller 16 is moved to close space 28 so the indent roller 12 presses against a surface of and indents the body of the elastomeric roller 16 to induce opposite curl in the media sheet moved through the nip formed by the two rollers.

In more detail, the sensor 134 of FIGS. 2A and 2B includes a reflective sensor 204 that has been mounted on a shaft 208 for bi-directional translation along the shaft. An actuator 108 is operatively connected to the sensor 204 to urge the sensor along the shaft bidirectionally. The controller 104 is operatively connected to the sensor 204 to receive the signal generated from the sensor. The controller 104 is configured to analyze the signal generated by the sensor 134 to detect ink contamination on the indent roller of the decurler. The reflective sensor includes a light emitter that directs light at the indent roller and a light receiver that generates a signal indicative of the light reflected from the roller surface into the receiver of the sensor. The sensor should be positioned to achieve an optimal focal length from the roller surface to the sensor. The sensor 204 can be configured in a number of ways. In the embodiment shown in FIG. 2A and FIG. 2B, the sensor 204 has a predetermined number of light sources and receivers that is less than the number required to extend the length of the indent roller. That is, the length of the sensor 204 is less than the length of the roller 12. Therefore, the sensor 204 is mounted to shaft 208 so it can move from one end of the shaft to the other to illuminate and receive light reflected from the surface of the roller 12. In this embodiment, the controller 104 synchronizes sensor position with a corresponding position on the indent roller. Alternatively, the number of light sources and receivers can be increased to a number that when positioned together in a linear array they extend the entire length of the indent roller. In this embodiment, the controller 104 correlates a position index for each receiver with a position on the indent roller. In this embodiment, the sensor can include a lens that extends the length of the indent roller and the lens focuses light to a linear array of receivers, such as a CCD array, in the sensor 204.

In both embodiments, a light-emitting element emits light toward the surface of the indent roller and a light-receiving element receives the reflected light from the surface of the roller. The receiver generates an electrical signal having a magnitude that corresponds to the amount of light received. Thus, the electrical signal has a greater magnitude when the light is reflected from a relatively bare indent roller. When the light strikes ink on the indent roller it is absorbed or scattered and does not reflect into the receiver. Consequently, the electrical signal has a lower magnitude. The controller 104 compares the signals received from the sensor 204 to a predetermined threshold to determine whether the signals indicate a level of ink has adhered to the indent roller that requires maintenance. These indications of maintenance are stored in a memory operatively connected to the controller and once the number of indications exceeds a predetermined threshold, the controller generates a signal for activating a contamination indicator 54. The number of indications can be the number of receivers in the sensor 204 generating a signal indicative of maintenance, the number of positions at which the sensor 204 generates a signal indicative of maintenance as it moves along the shaft 208, or the number of times that the sensor 204 generates the signal indicative of maintenance. The activation of the contamination indicator 54 includes activating an annunciator, an indicator light, or a text message on a user display, which informs an operator of the system that maintenance is required in the decurler.

Figure 3:
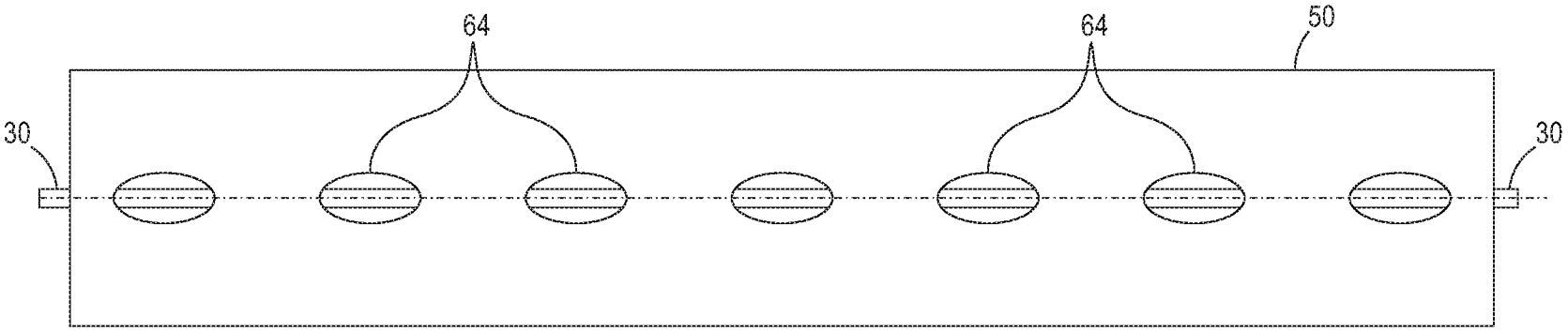
FIG. 3 is a view of the indent roller of the decurler shown in FIG. 2A and FIG. 2B through a frame.

A view of frame 50 from the perspective of the sensor 204 is shown in FIG. 3. The frame 50 has an upper planar member 60 that has an array of elongated openings 64 that extend linearly across the member. The planar member 60 is parallel to the indent roller 12. The controller 104 operates the actuator 108 to move the sensor 204 along the shaft 208 so the light emitters in the sensor 204 can direct light through the holes 64 and onto the indent roller 12. The specular light reflected by the surface of the roller 12 returns through the hole through which the light was emitted and is received by a receiver in the sensor. The receiver generates a signal indicative of the amount of specular light received and the controller compares that signal to a predetermined threshold to determine whether contamination of that portion of the indent roller has reached a level indicative of maintenance. Additionally, the controller 104 operates the actuator 108 to move the sensor 204 back and forth along the shaft 208 to ensure that the sensor directs light onto each sector of the indent roller over the course of several traversals of the shaft so contamination on each portion of the circumference of the indent roller 12 can be detected.

Prior to commencing operation of the sensor for indent roller purposes, the controller 104 operates the actuator 108 to move the sensor along shaft 208 while the sensor is operating to detect the signal magnitude differences between reflections received from the indent roller and those received from the solid portions of the frame between the openings 64. The controller 104 uses these signals to identify the positions along the shaft 208 that are over the frame 50. This positional data is stored and used during the monitoring of the indent roller 12 so the controller can ignore the signals corresponding to the solid portions of the frame for purposes of detecting contamination of the indent roller 12. The configuration of holes in the frame favors the use of a sensor that moves bidirectionally along a shaft because a continuous linear array of light emitters and receivers for the sensor 204 in this embodiment would mean some of the emitters and receivers would always be opposite solid portions of the frame. Thus, the moving sensor is more efficient and cost effective.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A decurler for use in an aqueous inkjet printer comprising:

an indent roller having a first end and a second end;

an elastomeric roller having a first end and a second end, the elastomeric roller and indent roller being parallel to one another and the elastomeric roller being configured to move to form a nip with the indent roller selectively to enable media sheets to pass through the nip and induce a curl in the media sheets that is opposite to a curl induced in the media sheets by aqueous ink ejected onto the media sheets prior to entry into the nip between the indent roller and the elastomeric roller;

a reflective sensor having a light emitter that is oriented to direct light onto a surface of the indent roller of the decurler and a light receiver that is oriented to receive specular reflections of the light directed onto the surface of the indent roller and to generate an electrical signal indicative of an amount of specular light reflection received by the light receiver from the surface of the indent roller; and a controller operatively connected to the reflective sensor to receive the electrical signal generated by the light receiver of the reflective sensor, the controller being configured to compare a magnitude of the electrical signal to a predetermined threshold and store an indication for maintenance of the indent roller in a memory in response to the magnitude of the electrical signal being less than the predetermined threshold.

2. The decurler of claim 1 further comprising:

a frame member interposed between the reflective sensor and the indent roller of the decurler, the frame member having a plurality of openings arranged in a linear array; and the controller being further configured to determine whether the light emitter and the light receiver of the reflective sensor is positioned opposite an opening in the frame member or a solid portion of the frame member.

3. The decurler of claim 2 further comprising:

a shaft that is parallel to the indent roller of the decurler and has a length that is at least as long as a length of the indent roller, the reflective sensor being mounted to the shaft for movement along the shaft and the reflective sensor having a length that is less than a length of the indent roller;

an actuator operatively connected to the reflective sensor, the actuator being configured to move the reflective sensor along the shaft; and the controller is further configured to operate the actuator to move the reflective sensor along the shaft, receive the generated electrical signal from the reflective sensor, and determine whether the reflective sensor is opposite one of the openings in the frame or one of the solid portions of the frame.

4. The decurler of claim 3, the controller being further configured to:

compare a number of the indications of maintenance stored in the memory to another predetermined threshold and generate an indication for maintenance of the indent roller in response to the number of stored maintenance indications being greater than the other predetermined threshold.

5. The decurler of claim 4, the controller being configured to generate the indication of maintenance by:

activating an annunciator, an indicator light, or a text message on a user display, the text message informing an operator of the printer that maintenance is required in the decurler.

6. The decurler of claim 3, the actuator being further configured to move the reflective sensor bidirectionally along the shaft; and the controller is configured to operate the actuator to move the reflective sensor bidirectionally along the shaft.

7. The decurler of claim 1, the reflective sensor comprising:

a linear array of light emitters and light receivers that extends at least a length of the indent roller.

8. The printer of claim 1, the reflective sensor comprising:

a linear array of light emitters and light receivers that extends at least a length of the indent roller.

9. An aqueous inkjet printer comprising:

a media feeding system configured to remove media sheets from a media sheet receptacle;

a media transport system configured to move media sheets through the aqueous inkjet printer;

at least one printhead configured to eject drops of aqueous ink onto media sheets as the media transport system moves the media sheets past the at least one printhead;

a decurler having an indent roller and an elastomeric roller, the elastomeric roller being configured to move and form a nip with the indent roller in the decurler to enable media sheets to pass through the nip and induce a curl in the media sheets that is opposite to a curl induced in the media sheets by aqueous ink ejected by the at least one printhead onto the media sheets prior to entry into the decurler;

a reflective sensor having a light emitter that is oriented to direct light onto a surface of the indent roller of the decurler and a light receiver that is oriented to receive specular reflections of the light directed onto the surface of the indent roller and to generate an electrical signal indicative of an amount of specular light reflection received by the light receiver from the surface of the indent roller; and a controller operatively connected to the reflective sensor to receive the electrical signal generated by the light receiver of the reflective sensor, the controller being configured to compare a magnitude of the electrical signal to a predetermined threshold and store an indication for maintenance of the indent roller in a memory in response to the magnitude of the electrical signal being less than the predetermined threshold.

10. The printer of claim 9 further comprising:

a frame member interposed between the reflective sensor and the indent roller of the decurler, the frame member having a plurality of openings arranged in a linear array; and the controller being further configured to determine whether the light emitter and the light receiver of the reflective sensor is positioned opposite an opening in the frame member or a solid portion of the frame member.

11. The printer of claim 10 further comprising:

a shaft that is parallel to the indent roller of the decurler and has a length that is at least as long as a length of the indent roller, the reflective sensor being mounted to the shaft for movement along the shaft and the reflective sensor having a length that is less than a length of the indent roller;

an actuator operatively connected to the reflective sensor, the actuator being configured to move the reflective sensor along the shaft; and the controller is further configured to operate the actuator to move the reflective sensor along the shaft, receive the generated electrical signal from the reflective sensor, and determine whether the reflective sensor is opposite one of the openings in the frame or one of the solid portions of the frame.

12. The printer of claim 11, the controller being further configured to:

compare a number of the indications of maintenance stored in the memory to another predetermined threshold and generate an indication for maintenance of the indent roller in response to the number of stored maintenance indications being greater than the other predetermined threshold.

13. The printer of claim 12, the controller being configured to generate the indication of maintenance by:

activating an annunciator, an indicator light, or a text message on a user display, the text message informing an operator of the printer that maintenance is required in the decurler.

14. The printer of claim 11, the actuator being further configured to move the reflective sensor bidirectionally along the shaft; and the controller is configured to operate the actuator to move the reflective sensor bidirectionally along the shaft.

15. A method of operating a printer comprising:

receiving specular reflections of light directed by a light emitter of a reflective sensor onto a surface of an indent roller of a decurler;

generating with a light receiver of the reflective sensor an electrical signal indicative of an amount of specular light reflection received by the light receiver from the surface of the indent roller;

receiving with a controller the electrical signal generated by the light receiver;

comparing with the controller a magnitude of the received electrical signal to a predetermined threshold; and storing in a memory with the controller an indication for maintenance of the indent roller in response to the magnitude of the electrical signal being less than the predetermined threshold to enable maintenance of the indent roller prior to accumulation of ink on the indent roller adversely affecting operation of the printer.

16. The method of claim 15 further comprising:

determining with the controller whether the light emitter and the light receiver of the reflective sensor are positioned opposite an opening in a frame member or a solid portion of the frame member, the frame member having a plurality of openings arranged in a linear array and being interposed between the indent roller of the decurler and the reflective sensor.

17. The method of claim 16 further comprising:

operating with the controller an actuator to move the reflective sensor along a shaft that is parallel to the indent roller of the decurler and has a length that is at least as long as a length of the indent roller, the reflective sensor having a length that is less than a length of the indent roller;

receiving the generated electrical signal from the reflective sensor with the controller; and determining with the controller whether the reflective sensor is opposite one of the openings in the frame or one of the solid portions of the frame.

18. The method of claim 15 further comprising:

comparing with the controller a number of the indications of maintenance stored in the memory to another predetermined threshold; and generating with the controller an indication for maintenance of the indent roller in response to the number of stored maintenance indications being greater than the other predetermined threshold.

19. The method of claim 18 further comprising:

generating with the controller the indication of maintenance by activating an annunciator, an indicator light, or a text message on a user display, the text message informing an operator of the printer that maintenance is required in the decurler.

20. The method of claim 15 further comprising:

operating the actuator with the controller to move the reflective sensor bidirectionally along the shaft.

* * * * *